US006594935B2

(12) United States Patent
Beretta

(10) Patent No.: US 6,594,935 B2
(45) Date of Patent: Jul. 22, 2003

(54) BUTT PAD MADE OF COMPOSITE MATERIAL FOR FIREARMS

(75) Inventor: Ugo Gussalli Beretta, Brescia (IT)

(73) Assignee: Fabbrica D'Armi Pietro Beretta S.p.A. (IT)

( * ) Notice: Subject to any disclaimer, the term of this patent is extended or adjusted under 35 U.S.C. 154(b) by 0 days.

(21) Appl. No.: 09/774,658

(22) Filed: Jan. 31, 2001

(65) Prior Publication Data

US 2001/0011434 A1 Aug. 9, 2001

(30) Foreign Application Priority Data

Feb. 3, 2000 (IT) ..... BS2000A0004

(51) Int. Cl.[7] ..... F41C 23/06
(52) U.S. Cl. ..... 42/74; 42/71.01
(58) Field of Search ..... 42/73, 74, 71.01, 42/72

(56) References Cited

U.S. PATENT DOCUMENTS

| | | | | | |
|---|---|---|---|---|---|
| 837,455 | A | * | 12/1906 | Duncan | 42/74 |
| 1,418,532 | A | * | 6/1922 | Caldwell | 42/74 |
| 2,438,142 | A | * | 3/1948 | Brower | 42/74 |
| 3,001,312 | A | * | 9/1961 | Campbell | 42/74 |
| 3,037,313 | A | * | 6/1962 | Gring, Jr. | 42/74 |
| 3,696,544 | A | * | 10/1972 | Webb | 42/74 |
| 4,504,604 | A | * | 3/1985 | Pilkington et al. | 523/167 |
| 4,683,671 | A | * | 8/1987 | Farrar | 42/74 |
| 4,998,367 | A | * | 3/1991 | Leibowitz | 42/71.02 |
| 5,265,366 | A | * | 11/1993 | Thompson | 42/74 |
| 5,461,813 | A | * | 10/1995 | Mazzola | 42/74 |
| 6,305,115 | B1 | * | 10/2001 | Cook | 42/74 |

FOREIGN PATENT DOCUMENTS

| | | | | |
|---|---|---|---|---|
| AU | 147439 | * | 7/1952 | 42/74 |
| DE | 252899 | * | 10/1912 | 42/74 |
| EP | 611 189 A1 | * | 8/1994 | 42/74 |
| GB | 7269 | * | 4/1895 | 42/74 |

* cited by examiner

*Primary Examiner*—Stephen M. Johnson
(74) *Attorney, Agent, or Firm*—McGlew and Tuttle P.C.

(57) ABSTRACT

The invention concerns a butt pad for the stock of an individual firearm held against the shoulder, such as a shotgun, a sporting firearm, a military firearm, whether smoothbore or rifled which is made up of an external sheath or housing (12) elastically variable in shape consequent to pressure applied externally, by an internal high viscosity element (13), hermetically enclosed in the external sheath (12) and used to absorb and dispel the recoil energy, and a semi-rigid base and support element (14), integral with the external sheath housing and having a device (15) for a removable anchorage of the butt pad to the stock.

9 Claims, 3 Drawing Sheets

BUTT PAD MADE OF COMPOSITE MATERIAL FOR FIREARMS

FIELD OF THE INVENTION

The present invention concerns the shotgun, shooting, military etc., sector in general and refers in particular to a butt pad for these firearms.

BACKGROUND

Firearms usually have a wooden stock with a so-called butt pad fitted to the bottom as protection against the stock cracking when the firearm is stood up or to rest against the shoulder of the shooter when the firearm is being used. Butt pads are usually made out of a single homogenous material, generally rubbery, comparatively elastic and soft, honeycombed or non-honeycombed, to fit the shoulder of the shooter and to soften the blow from the recoil received from the firearm following firing.

In a firearm free to recoil, in order to reach the desired muzzle velocity, the acceleration of the propelling charge is always generated at the expense of an acceleration in the opposite direction of the firearm itself or recoil "mass".

In particular, in an individual firearm, such as a rifled or smoothbore shotgun assumed free to retract, the quantity of motion M*V conventionally acquired by said firearm at the moment the charge exits the muzzle of the barrel, Is equal in value and opposite in sign compared to the quantity of motion m*v of the load, where the symbols M, V, m, v, indicate respectively the mass and the velocity of the firearm and the load. A corresponding amount of Kinetic energy is associated with the recoil velocity of the firearm, energy where the shoulder of the shooter the stock and relative butt pad of the firearm usually rests against, will be called on to contrast and annul by undertaking an action of resistance.

This work and consequently the force the shoulder exerts in order to slow down and then stop the retrograde motion of the firearm will, due to the considerations given above regarding the quantity of motion, be greater in proportion to the value of the mass and the velocity of the propelling charge and less in proportion to the mass of the firearm.

Techniques today enable arms to be manufactured that tend to be lighter but nevertheless reliable and at the same time there has been a progressive increase, for example in shotgun cartridges available on the market, in the quantity of the mass of the maximum propelling load. All this has made the problem of the "recoil" action of a shotgun against the shoulder more serious.

In the attempt to decrease the force against the shoulder and the consequent inconvenience suffered by the shooter, various solutions have been devised over the years as regards to butt pads for shotguns and/or sporting guns.

For example, in the so-called "honeycombed" type of rubber butt pads, attempts have been made to optimise the structure of the butt pad so as to make it "selectively" more pliable according to the axis of the firearm, maintaining at the same time good lateral stability. This effect is achieved by carefully studying the position and shape of the "empty" and "solid" sections of the butt pad itself.

These types of butt pad, although having the advantage of being more pliable and therefore having a longer "stroke" in opposition to the motion of the firearm, have, because of this, an increased relative motion between the stock and the face of the shooter in that he rests his cheek on it and this can be troublesome or even cause microtraumas.

Furthermore these types of butt pads, because of the way in which they are constructed, which implies irremovable and unacceptable moulding faults on the side surfaces of the same, must be fitted to the profile of the stock on which it is assembled with consequent increase in costs and loss of possibility to interchange.

In other types of butt pad, other soft materials with particular characteristics favouring absorption were used. Even in this case, however, the inconvenience of having to support "rubbing" of the stock against the cheek remains. In general these materials, having modest mechanical resistance characteristics, are easily damaged and suffer from wear that shortens their lifespan. There are examples where the dissipation of recoil energy is achieved by shock absorbers (operating hydraulically, with springs, with elastomers, by friction) inserted in the stock and connected to the butt pad using an actuator head. In this way, the desired effect is achieved through a force counteracting the recoil motion and the relative passive dissipation associated with the relative motion between stock and butt pad.

These butt pads, although usually characterised by good efficiency, do however, as can easily be imagined, present manufacturing complications of a mechanical nature, and are also more expensive.

AIMS AND DISCLOSURES OF THE INVENTION

Given the above the aim of the present invention is to supply a butt pad having a new conception so as to reduce the discomfort deriving from recoil following firing of an individual firearm held against the shoulder.

Another aim of the invention is to submit a specific method of fixing the butt pad to the stock, so as to take full advantage of the characteristics of the new butt pad.

From observing the technical components in the field of sporting goods, the use of materials having particular properties so as to protect the bone and muscle structure involved in the sporting activity in question, is well known.

Usually these materials are characterised by high energy absorption achieved by internal dissipation (viscous effect) and are used in combination with other materials, generally having a retaining function, in order to lessen the repeated impulsive stress deriving from the sport practised, otherwise often responsible for known pathologies.

This is the case, for example, of the soles of shoes for jogging where, inside the sole itself which acts as a retainer, there is a gel cushion, or bicycle saddles where, in the same way, this material is placed inside the saddle in line with the perineal zone.

The function of these materials is to deform, due to external actions, so that:

- Part of the energy due to the impulsive stress (or impact) is absorbed; this energy will then be dissipated by the material due to its internal resistance (viscosity);
- The impact stress is spread as uniformly as possible over the anatomic part in question (for example the arch of the foot, the shoulder); this effect is achieved, during the shock absorbing action, by hydrostatic distribution of the pressure inside the housing.

The abovementioned aims of the invention are achieved, in line with the concepts based on some of the technical components already mentioned, in a composite structured butt pad which includes an elastically variable shaped external sheath, a high viscosity element housed in said sheath and congruent with the variations in shape of the latter, and a base element and semi-rigid support attached to the sheath and designed for fitting the butt pad to the stock of a firearm.

BRIEF DESCRIPTION OF THE DRAWINGS

The details of the invention will become clearer from the descriptions made in reference to the enclosed drawings, whereby:

FIG. 1 is an overall view of a butt pad 10 fixed to a stock 11 of a firearm. The butt pad 10 is made up essentially of three components: an external sheath or container 12; an internal element 13 housed in the sheath 12; and a base and support element 14 equipped with a device 15 for fixing the butt pad to the stock 11.

The function of the external sheath 12 is to contain the internal element 13 and to transfer the stress deriving from the use of the firearm. It can be made for example out of a polyurethane TPE material or a material which is elastically deformable.

The function of the internal element 13, which can be either in one section or divided into several parts, is to absorb the impulsive Kinetic energy congruent with the use of the firearm. It can be made, for example, from a silicone gel or from a high viscosity material able to adapt to the shapes of the sheath, when the latter is compressed.

Figure 1:
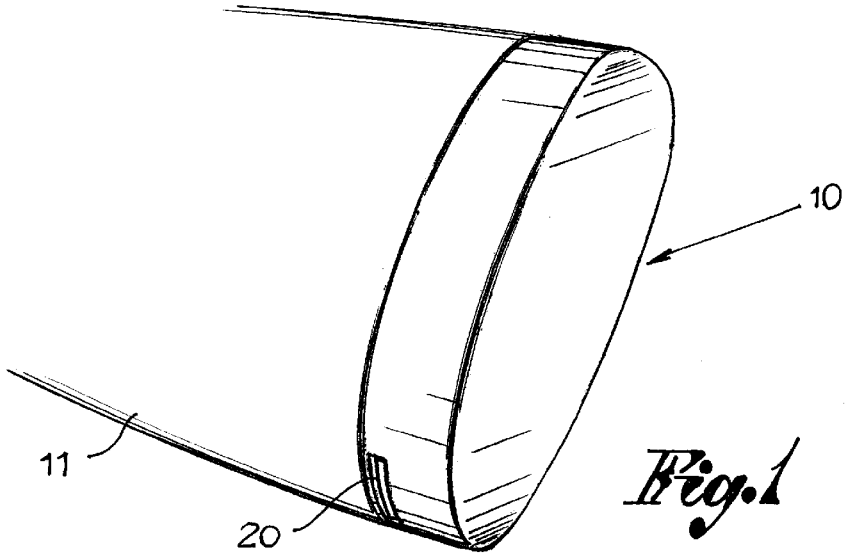
FIG. 1 is a view of a butt pad applied to a stock.
Figure 2:
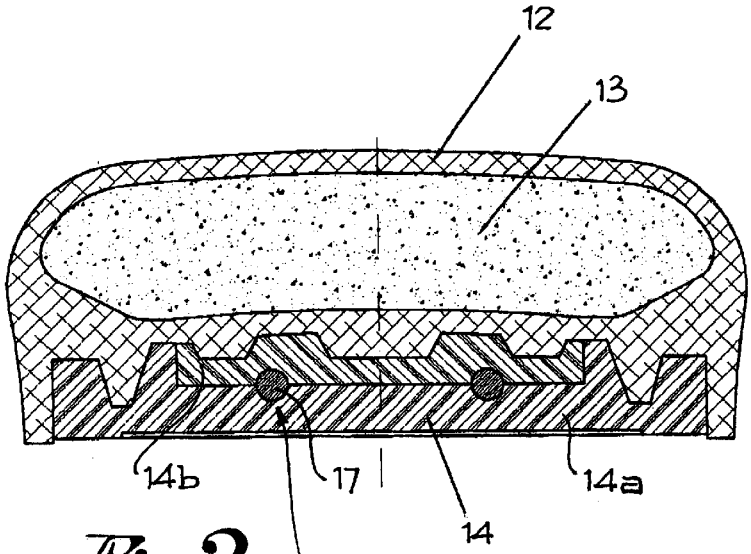
FIG. 2 is a cross section of the butt pad in FIG. 1.
Figure 3:
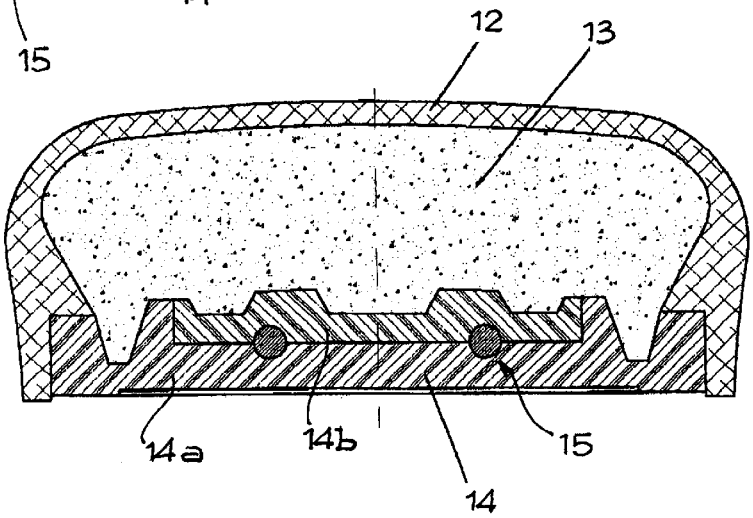
FIG. 3 is a similar cross section of the butt pad in one of its different variations.
Figure 4:
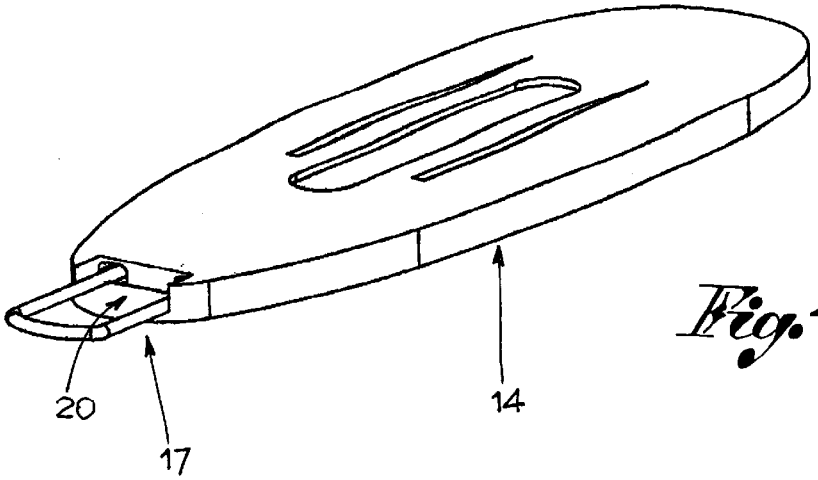
FIG. 4 shows on the base element for fixing the butt pad in position

The base and support element 14 is attached to the external sheath, integral or integrated with the latter—FIGS. 2, 3—and is used to provide a removable and interchangeable attachment of the butt pad 10 to the stock 11. This element 14 can be a semi-rigid material such as, for example TP polyurethane.

The function of the butt pad once applied to the stock of a firearm is intuitive.

At the moment of shooting, the firearm moves back towards the shoulder thrust by the pressure of the gas in the cartridge chamber. Shortly after the load has left the muzzle of the barrel, the firearm, which in the meantime has moved backwards a few millimeters, reaches its maximum velocity and the butt pad begins to press against the shoulder. Gradually as the reaction force of the shoulder increases, there is a progressive crushing of the butt pad with consequent compression of the absorbent material it contains. The result achieved is an enlargement of the support base of the butt pad in contact with the shoulder fitting to the anatomic shape of the shooter, decrease in the absolute pressure and a hydrostatic distribution of the force (increase in pressure distribution uniformity).

The butt pad is interchangeable and easy to replace on the stock thanks to the particular means of fixing 15, which is an integral part of the invention.

When fixing a butt pad to a stock, it is common practice to use a couple of tap screws for wood to be inserted into the body of the butt pad through two holes made in the surface resting against the shoulder and at the same distance from the axis of the stock. This solution, suitable where the butt pad is made of an homogenous material, is not suitable for the composite butt pad in the invention, in that the holes for the screws would create discontinuity in the sheath or housing 12 with the danger of the viscous element 13 leaking out.

In order to be able to rapidly assemble/disassemble and overcome the aforementioned problem, the housing sheath encloses a completely leakproof chamber for the viscous element 13. The sheath is moulded separately from the base element. Sheath and base element are then assembled together—FIGS. 2 and 3, and after the viscous element has been inserted, they are sealed using a seal which makes them inseparable.

As said above, the traditional system of holding the butt pad in place using tap screws is no longer suitable and in agreement with the invention it is replaced by a device 15 which enables it to be fixed to the stock avoiding having to make any holes in the butt pad which would otherwise be necessary for the screws.

This device consists of two anchoring bushings 16 to be fixed to the bottom of the stock each with a peripheral groove 16', and a lock/release spring 17 placed in the semi-rigid base 14 of the butt pad 10 with the function of engaging said bushings.

Figure 5:
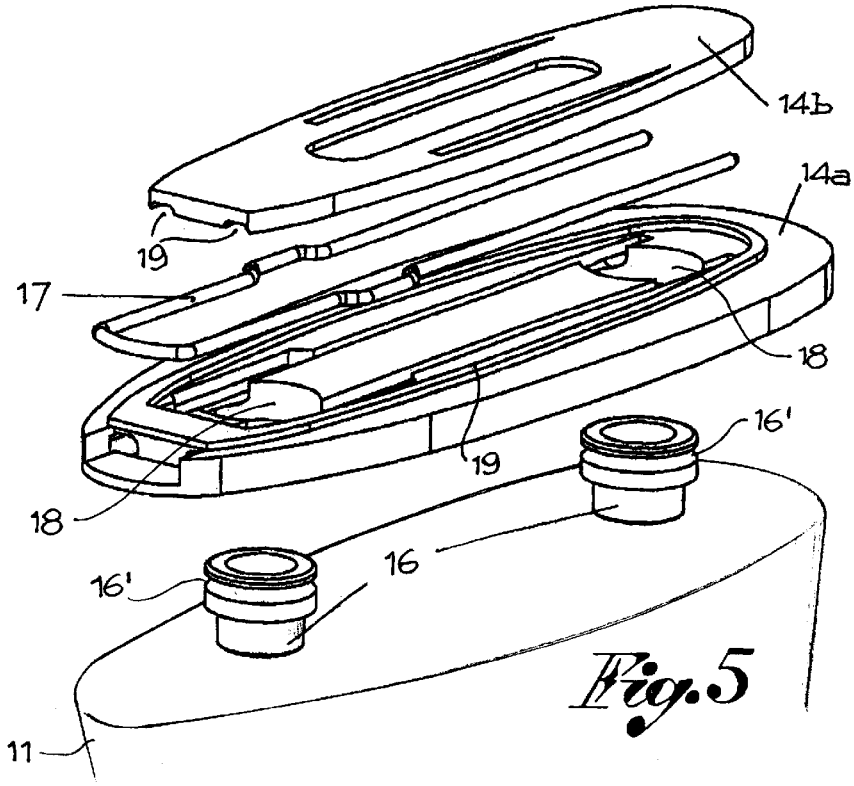
FIG. 5 is an exploded view of the components of the base element in FIG. 4
Figure 6:
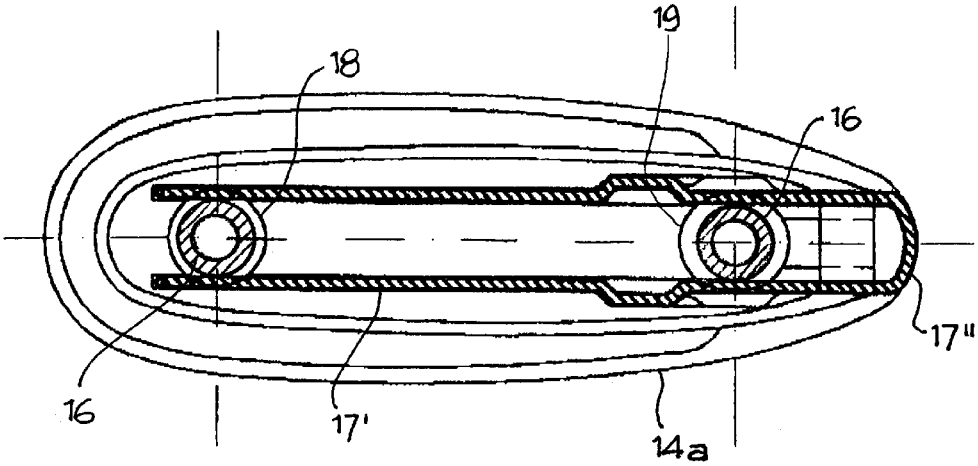
FIGS. 6 and 7 show the relative locking and unlocking positions of the butt pad.
Figure 7:
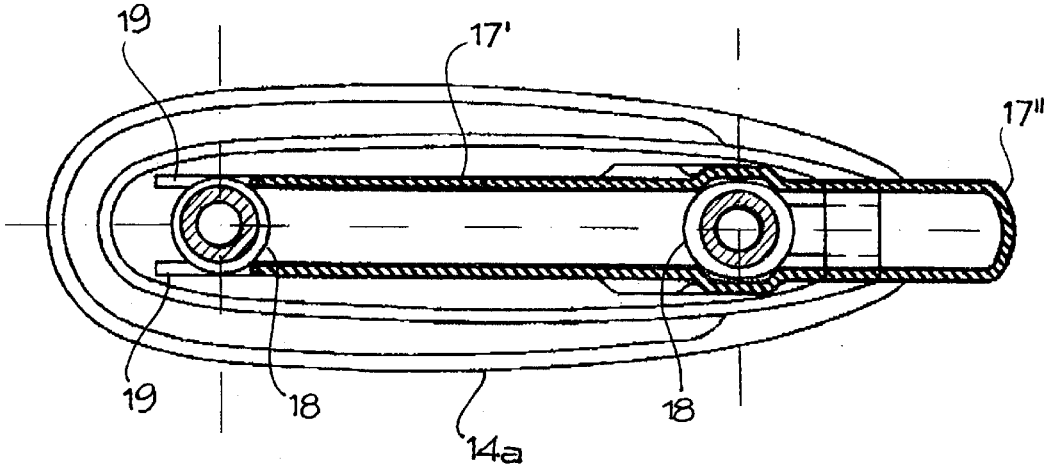

In this way, the semi-rigid base 14 is made up of—FIG. 5—two complementary superimposed parts 14*a*, 14*b* which both have two dead holes 18 to receive the bushings 16 fixed to the stock and which between them, in a direction at a tangent to the dead holes, from the sides opposite to the latter, enclose, for example, two grooves 19 with a circular cross-section, housing the lock/release spring 17. AS shown, this spring has two longitudinal arms 17', which are inserted in these grooves 19 so as to engage in the peripheral groove 16' of the anchoring bushings 16 and a transversal part 17", which connects the two arms 17' and which acts as a grip for the movements of the spring 17 between the two opposite positions: one being the butt pad locked and the other the butt pad released positions as can be seen in FIGS. 6 and 7, respectively. For these movements, spring 17 can be accessed through an opening 20 in the semi-rigid base of the butt pad on a level with the transversal grip section 17".

What is claimed is:

1. A butt pad for a firearm, the butt pad comprising:

a housing elastically variable in shape in response to pressure;

a base connected to said housing, said base and said housing both defining a hermetically sealed chamber;

a viscous element arranged in said hermetically sealed chamber, said vicous element absorbing and dispelling recoil energy from the firearm;

two anchoring bushings connectable to the firearm, said base defining two openings receivable of said two bushings;

a lock slidable in said base and engagable with said two anchoring busings to have the butt pad connectable to the firearm.

2. A butt pad in accordance with claim 1, wherein:

said viscous element and said housing cause morphological adaptation of said housing to, and a substantially uniform distribution pressure to, a shoulder of a user of the firearm.

3. A butt pad in accordance with claim 1, wherein:

said base is semi-rigid.

4. A butt pad in accordance with claim 1, wherein:

said viscous element is directly in contact with said housing and said base.

5. A butt pad in accordance with claim 1, wherein:

said lock is slidable substantially parallel to said base between a locked and a released position.

6. An individual firearm stock shoulder butt pad, comprising a single body connectable to and a removable from a stock of the firearm, the single body comprising:

an external sheath or housing elastically variable in shape upon the application of pressure to an external surface of the external sheath or housing and upon a transfer of recoil energy towards the interior of the external sheath or housing;

an internal viscous material hermetically enclosed in the external sheath or housing and used to absorb and dispel the recoil energy transferred through said external sheath or housing and to allow a morphological adoption of the butt pad and a uniform distribution of the pressure to the shoulder;

a semi-rigid base or support element integral with the external sheath or housing and having; and a fixing device integrated in said base or support element for a removable anchorage of the single body to the stock, the fixing device being made up of two anchoring bushings fixable to the stock and insertable into corresponding dead holes in the base or support element, and a lock/release spring inserted in this base or support element and interacting with said anchoring bushings, said spring moving between lock and release positions in a direction perpendicular to said bushings.

7. A butt pad according to claim 6, wherein the external sheath or housing is made of a flexible morbid polyurethane material, the internal viscosity element is a gel and the base or support element is a semi-rigid polyurethane material.

8. A butt pad according to claim 6, wherein the external sheath or housing fully encloses an hermetic chamber containing the viscosity element and where the base or support element is applied and fixed to the sheath or housing.

9. A butt pad according to claim 6, wherein both the external sheath or housing and the base or support element are integrated to jointly enclose an hermetic chamber containing the viscosity element.

* * * * *